United States Patent [19]

Geschka et al.

[11] 4,297,859

[45] Nov. 3, 1981

[54] AUTOMATIC TOWEL DISPENSER

[75] Inventors: Hugo-Werner Geschka, Düsseldorf; Bernd Beitecke, Dortmund, both of Fed. Rep. of Germany

[73] Assignee: LuK Lamellen und Kupplungsbau GmbH, Bühl, Fed. Rep. of Germany

[21] Appl. No.: 50,639

[22] Filed: Jun. 21, 1979

[30] Foreign Application Priority Data

Jun. 21, 1978 [DE] Fed. Rep. of Germany ..... 2827180

[51] Int. Cl.[3] ..... A47K 10/30

[52] U.S. Cl. ..... 68/13 R; 226/118

[58] Field of Search ..... 68/9, 13 R; 312/38; 38/2; 221/27–29; 226/115, 118, 127–133; 15/40

[56] References Cited

U.S. PATENT DOCUMENTS

| | | | |
|---|---|---|---|
| 1,689,622 | 10/1928 | Clover | 312/38 |
| 2,295,955 | 9/1942 | La Page | 68/13 R X |
| 4,022,368 | 5/1977 | Ando et al. | 226/118 |

FOREIGN PATENT DOCUMENTS

| | | | |
|---|---|---|---|
| 1900676 | 8/1970 | Fed. Rep. of Germany | 68/13 R |
| 2602278 | 7/1977 | Fed. Rep. of Germany | 68/13 R |

*Primary Examiner*—Philip R. Coe

*Attorney, Agent, or Firm*—Herbert L. Lerner

[57] ABSTRACT

An automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein and a second supply chamber for variably stacking a plurality of cleaned towel sections of the endless towel therein, the sections of the towel being depositable from above into the respective supply chamber therefor and being withdrawable upwardly from below an overlying loop thereof, includes guide means disposed in an upper region of the second supply chamber, the inlet slot being located in a lower region of the first supply chamber, and the delivery slot being located in a middle region of the towel dispenser, the sections of the towel withdrawable upwardly from below the overlying loop thereof being reversible into a downward travel direction thereof by the guide means, guidable out of the delivery slot and re-introducible, in the form of a loop extending around a region adjacent the middle region of the towel dispenser, into the housing through the inlet slot.

4 Claims, 1 Drawing Figure

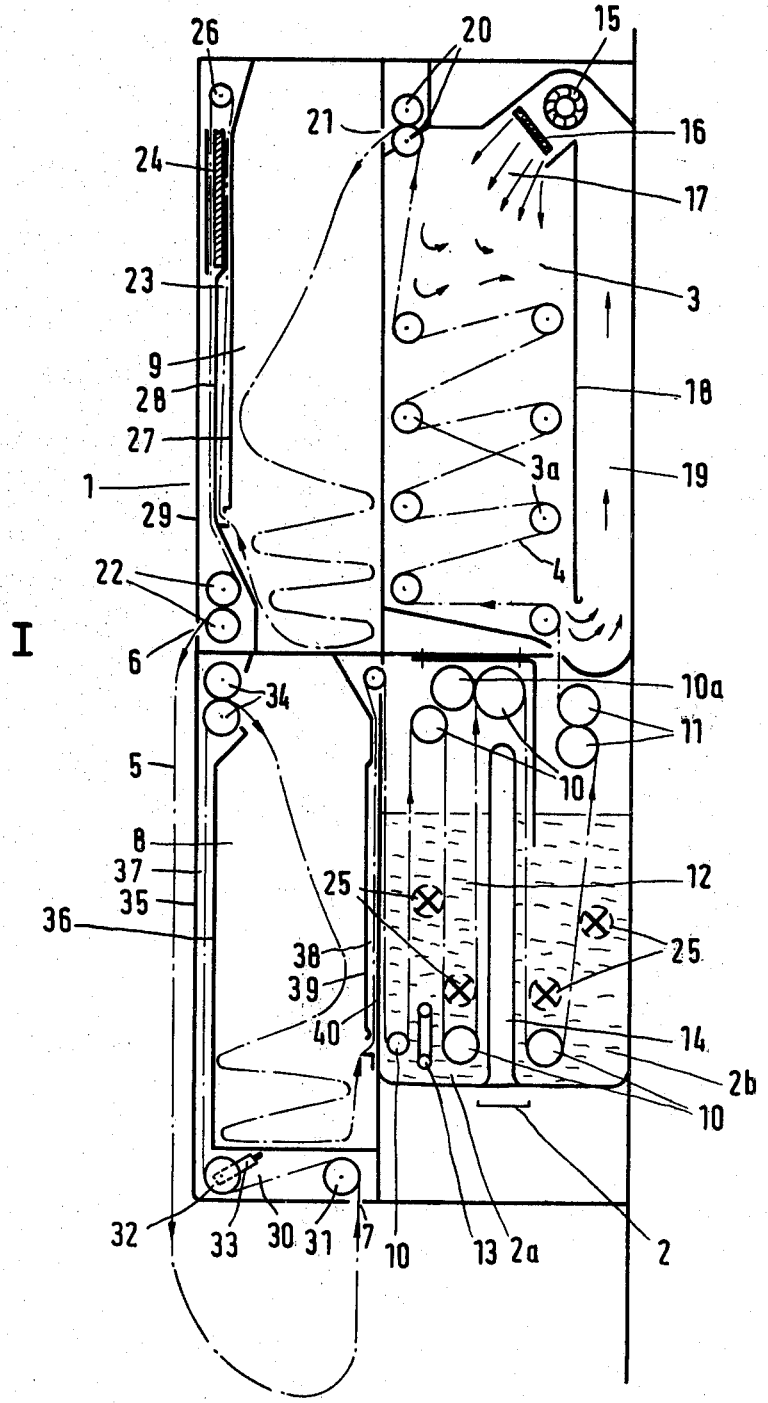
26
20
15
21
16
24
17
23
3
9
18
28
27
3a
19
1
29
4
22
I
6
10a
34
11
5
10
8
12
37
25
35
36
25
38
39
40
14
2b
10
32
33
30
31
7
10
13
2a
2

AUTOMATIC TOWEL DISPENSER

The invention relates to an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being passable through the washing and drying chambers, while washing and drying processes are set into operation, and being depositable in the second supply chamber for cleaned towel sections, the sections of the towel being depositable from above into the respective supply chamber therefor and being withdrawable upwardly from below an overlying loop thereof, past the supply of towel sections and out of the respective supply chambers.

Such a towel dispenser has become known heretofore from German Published Non-Prosecuted Application DE-OS No. 26 02 278.

It is an object of the invention of the instant application to provide an automatic towel dispenser wherein the towel sections are made available for the use in a more advantageous manner than heretofore and wherein the guidance of the towel is improved by avoiding the formation of undesired folds.

With the foregoing and other objects in view, there is provided, in accordance with the invention, in an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being passable through the washing and drying chambers, while washing and drying processes are set into operation, and being depositable in the second supply chamber for cleaned towel sections, the sections of the towel being depositable from above into the respective supply chamber therefor and being withdrawable upwardly from below an overlying loop thereof, past the supply of towel sections and out of the respective supply chambers, the improvement therein comprising guide means, such as a guide roller, disposed in an upper region of the second supply chamber, the inlet slot being located in a lower region of the first supply chamber, and the delivery slot being located in a middle region of the towel dispenser i.e. between the upper and the lower housing contours, the sections of the towel withdrawable upwardly from below the overlying loop thereof being reversible into a downward travel direction thereof by said guide means, guidable out of the delivery slot and reintroducible, in the form of a loop extending around a region adjacent the middle region of the towel dispenser, into the housing through the inlet slot.

In accordance with another feature of the invention, the automatic towel dispenser includes a passageway chamber separated from the first supply chamber, first deflecting means for the towel received in the passageway chamber associated with and downstream of the towel, second deflecting means disposed in a forward region of the first supply chamber downstream from the first deflecting means in travel direction of the towel, means for guiding the towel from the second deflecting means upwardly past the supply of soiled towel sections and for depositing the towel from above in the first supply chamber.

In accordance with a further feature of the invention, the second deflecting means comprise a weighting cylinder loading the towel with a weight, and always ensuring a given amount of tension in the towel section located between the weighting cylinder and drawing-in rollers or cylinders provided at the upper region of the supply chamber.

In accordance with a concomitant feature of the invention, the automatic towel dispenser includes a first vertical shaft adjacent to and separated from the second supply chamber, a second vertical shaft separated from the first supply chamber and a third vertical shaft also separated from the first supply chamber, and means for guiding the towel in the second supply chamber upwardly through the first vertical shaft, means for guiding the towel upwardly through the second vertical shaft so as to deposit the towel in the first supply chamber, and means for guiding the towel upwardly from the first supply chamber to the washing chamber.

Although the invention is illustrated and described herein as embodied in an automatic towel dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic view of the automatic towel dispenser according to the invention.

Referring now to the FIGURE of the drawing, there is shown therein the automatic towel dispenser I according to the invention having a housing 1 with a washing chamber 2 and a drying chamber 3 provided therein. An endless towel 4, that is to be passed through the chambers 2 and 3, has cleaned towel sections 5 thereof, which are either ready or to be made ready for use, that extend between a delivery slot 6 and an inlet slot 7 on the outside of the housing 1. Between the inlet slot 7 and the washing chamber 2, as viewed in the direction of travel of the towel 4 represented by the various arrow heads shown thereon, a supply chamber 8 for the variable or alternating stacking of several used towel sections is provided. Between the drying chamber 3 and the delivery slot 6, a supply chamber 9 for the variable or alternating stacking of several clean towel sections is also provided. After the supply chamber 9 is sufficiently empty or the supply chamber 8 is sufficiently full, the towel dispenser is set into operation and a suitable number of soiled towel sections from the supply chamber 8 is initially passed through the washing and drying chambers 2 and 3 and then deposited in the supply chamber 9 for clean toweling.

The washing chamber 2 is made up of a wash tub 2*a* and a rinsing tub 2*b*, through which the towel 4 is conducted in the form of at least approximately vertical loops and over deflection rollers 10. At the outlet from the wash tub 2*a*, squeezing cylinders 10*a* are provided, and at the outlet from the rinsing tube 2*b*, squeezing cylinders 11. Heating rods 13 or the like are provided for heating the washing solution 12 in the wash tub 2*a*. A partition 14 is disposed between the wash and rinsing tubs 2*a* and 2*b*, respectively.

After passing the squeezing cylinders 11, the towel 4 arrives in the drying chamber 3, wherein it is guided in looping form over deflection or reversing rollers 3*a*. A blower 15 with a heater 16 is provided in an upper region of the drying chamber 3, and blows drying air in the direction of the arrows 17 onto the towel 4. Through an intake or induction shaft 19 separated by a partition 18 from the drying chamber 3, the drying air is sucked upwardly from below to the blower 15 and is there blown out again into the drying chamber 3. The drying air is thus displaced in a counterflow manner with respect to the travel of the towel 4. A pair of transport rollers 20 advances the dried towel 4 through an inlet slot 21 into the supply chamber 9, depositing the towel 4 therein in loop form. If fresh towling is required, either, by pressing a suitable actuation switch, a pair of rollers 22 is set in motion for a given amount of rotation or by manually pulling down the towel section 5, fresh toweling is drawn out through the slot 6, whereby the fresh toweling located in the supply chamber 9 is taken from the lower layers thereof and drawn upwardly through an unfolding shaft 23 and, if desired or necessary, past an ironing device 24 and further on to the rollers 22 and out through the slot 6.

It is apparent that the towel is withdrawn from the supply chamber 9 for washed and dried towel sections by means of a deflection roller 26 which is provided in the upper region of the supply chamber 9 and through which the towel is deflectable and guidable out therefrom downwardly through the delivery slot 6 which is located in a middle region of the towel dispenser.

The towel unfolding shaft 23 is formed by a partition 27 and another wall 28, while a shaft for guiding the towel downwardly through the rollers 22 is formed between the wall 28 and the housing wall 29.

The towel section 5 projecting out of the towel dispenser practically extends around the supply chamber 8 for soiled towel sections and is reintroduced through the inlet slot 7 formed in a lower rear region of the supply chamber 8. Following or downstream of the inlet slot 7, in travel direction of the towel, a passage chamber 30 separated from the supply chamber 8 for soiled toweling is provided, wherein a deflecting roller or cylinder 31 and another deflecting roller 32 are disposed. The deflecting roller 32 is guided by a through shaft thereof in a coulisse or link 33 and loads or tensions the towel section between the roller 31 and the drawing-in roller 34 through its own weight or through an additional spring loading the deflecting roller 33. The towel is led upwardly to the rollers 34 in a shaft 37 between the outside wall 35 and a wall 36 and, from there, is deposited downwardly from the above in looping form in the supply vessel or chamber 9.

The used or soiled towel sections are withdrawn from the supply chamber 8, just as the washed and dried towel sections are withdrawn from the supply chamber 9, upwardly through a shaft 38, which is formed by a wall 39 and the housing wall 40, from beneath the supply deposited thereabove.

There are claimed:

1. An automatic towel dispenser having a housing formed with a delivery slot and an inlet slot and containing a washing and a drying chamber for an endless towel passable therethrough and having a cleaned section available for use extending outside the housing between the delivery slot and the inlet slot, respectively, formed in the housing, means defining a path of travel of the endless towel from the inlet slot to the washing chamber and from the drying chamber to the delivery slot, the housing also containing a first supply chamber for variably stacking a plurality of soiled towel sections of the endless towel in loops therein, the first supply chamber being located between the inlet slot and the washing chamber, as viewed in travel direction of the towel, and the housing further containing a second supply chamber for variably stacking a plurality of cleaned towel sections of the endless towel in loops therein, the second supply chamber being located between the drying chamber and the delivery slot, as viewed in travel direction of the towel, the travel path of the endless towel including a travel path portion for the soiled towel sections through the washing and drying chambers wherein the soiled towel sections are, respectively, washed and dried, respective travel path portions extending from above into the first and the second supply chamber for depositing, respectively, the soiled and the cleaned towel sections therein from above, and respective travel path portions extending upwardly from below out of the first and the second supply chamber for withdrawing the respective soiled and cleaned towel sections upwardly from below an overlying loop thereof, past the respective supply of towel sections and out of the respective supply chambers, the improvement therein comprising guide means disposed in an upper region of the second supply chamber, the inlet slot being located in the towel dispenser below the first supply chamber, and the delivery slot being located in a middle region of the towel dispenser, said guide means defining a reversing part of the travel path for reversing upward travel of the towel sections in the second supply chamber into downward travel thereof out of the delivery slot and means for guiding the towel sections out of the delivery slot and reintroducing them, in the form of a loop extending around a region adjacent the middle region of the towel dispenser, into the housing through the inlet slot.

2. Automatic towel dispenser according to claim 1 including a passageway chamber separated from the first supply chamber, first deflecting means for the towel received in said passageway chamber associated with and downstream from the inlet slot in travel direction of the towel, second deflecting means disposed in a forward region of the first supply chamber downstream from the first deflecting means in travel direction of the towel, means for guiding the towel from said second deflecting means upwardly past the supply of soiled towel sections and for depositing the towel from above in the first supply chamber.

3. Automatic towel dispenser according to claim 2 wherein said second deflecting means comprise a weighting cylinder loading the towel with a weight.

4. Automatic towel dispenser according to claim 1 including a first vertical shaft adjacent to and separated from the second supply chamber, a second vertical shaft separated from the first supply chamber and a third vertical shaft also separated from the first supply chamber, and means for guiding the towel in the second supply chamber upwardly through said first vertical shaft, means for guiding the towel upwardly through said second vertical shaft so as to deposit the towel in the first supply chamber, and means for guiding the towel upwardly from the first supply chamber through said third vertical shaft to the washing chamber.

* * * * *